US007062054B2

(12) United States Patent
Nishikawa et al.

(10) Patent No.: US 7,062,054 B2
(45) Date of Patent: Jun. 13, 2006

(54) SPEAKER DEVICE

(75) Inventors: Akira Nishikawa, Hyogo (JP); Akira Motojima, Hyogo (JP); Hiroyuki Yoshii, Nara (JP)

(73) Assignees: Fujitsu Ten Limited, Kobe (JP); Timedomain Corporation, Ikoma (JP)

( * ) Notice: Subject to any disclaimer, the term of this patent is extended or adjusted under 35 U.S.C. 154(b) by 113 days.

(21) Appl. No.: 10/452,279

(22) Filed: Jun. 3, 2003

(65) Prior Publication Data

US 2004/0017920 A1 Jan. 29, 2004

(30) Foreign Application Priority Data

Jun. 7, 2002 (JP) ..... 2002-167797

(51) Int. Cl.
*H04R 25/00* (2006.01)
*H04R 1/02* (2006.01)

(52) U.S. Cl. ..... 381/182; 381/389

(58) Field of Classification Search ..... 181/144, 181/145; 381/87, 89, 182, 337, 338, 339, 381/386, 395, 345, 351, 389
See application file for complete search history.

(56) References Cited

U.S. PATENT DOCUMENTS 3,993,345 A 11/1976 Croup
4,783,820 A 11/1988 Lyngdorf et al.
4,805,221 A * 2/1989 Quaas ..... 381/335
5,323,466 A * 6/1994 Geddes ..... 381/71.5
5,862,242 A * 1/1999 Takewa et al. ..... 381/398
6,389,146 B1 * 5/2002 Croft, III ..... 381/345
6,678,384 B1 * 1/2004 Kowaki et al. ..... 381/182

FOREIGN PATENT DOCUMENTS

| | | | |
|---|---|---|---|
| EP | 1 162 864 A2 | | 12/2001 |
| JP | 05-328473 | * | 12/1993 |
| JP | 05328473 | | 12/1993 |
| JP | U 6-66194 | | 9/1994 |
| JP | U 3008172 | | 12/1994 |
| JP | A 8-317489 | | 11/1996 |
| JP | A 11-41686 | | 2/1999 |
| JP | A 2001-78285 | | 3/2001 |

* cited by examiner

*Primary Examiner*—Sinh Tran
*Assistant Examiner*—Brian Ensey
(74) *Attorney, Agent, or Firm*—Oliff & Berridge, PLC

(57) ABSTRACT

A speaker device has a pair of speaker units each including a magnetic circuit. The magnetic circuits are opposed and connected to each other by a binding member. Vibrations generated by the speaker units are canceled to each other so that the occurrence of unnecessary vibrations can be suppressed and the transient characteristic can be improved. Acoustic load members are arranged in the front portions of frames so that the resonance frequency can be lowered and a band of reproducing sound of low frequency can be expanded.

12 Claims, 11 Drawing Sheets

(a)

NOT CONNECTED (SPEAKER UNITS ARE DIRECTLY SCREWED TO BOX)

(CONT.)

(FIG. 5 CONTINUED)
(b)
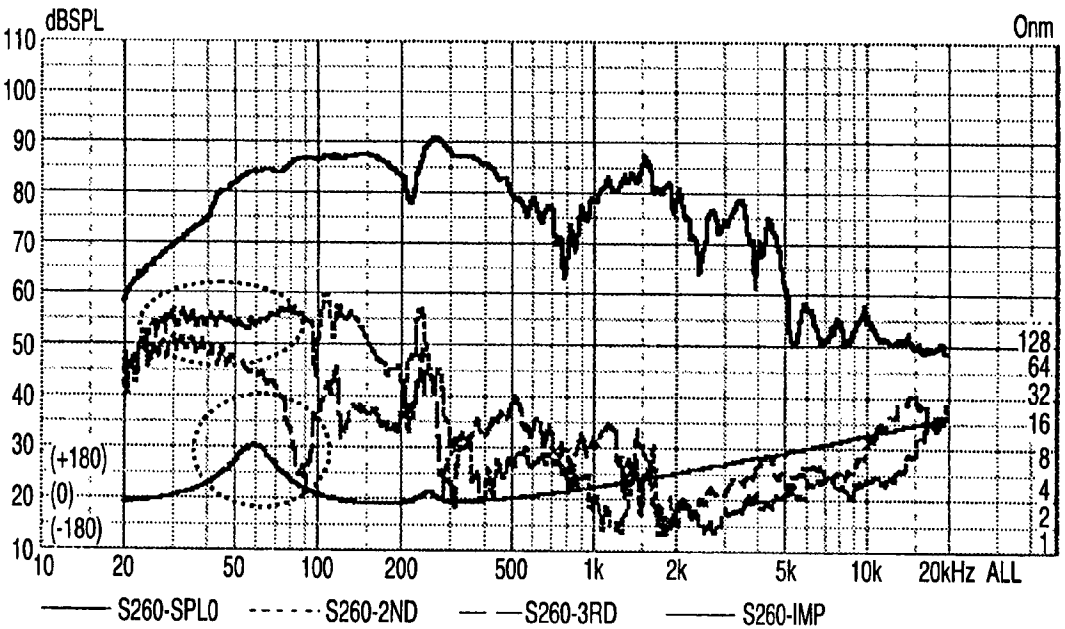
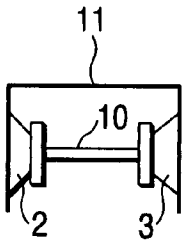
CONNECTED (a)

NOT CONNECTED
(SPEAKER UNITS ARE DIRECTLY SCREWED TO BOX)

(CONT.)

(FIG. 6 CONTINUED)
(b)
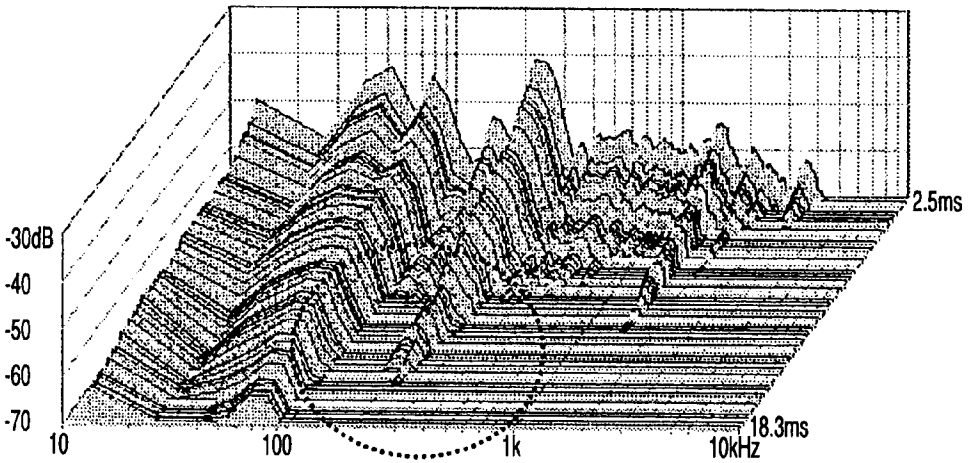
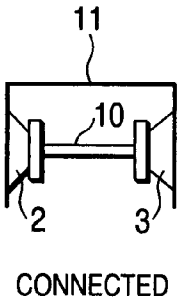

(a)

NO ACOUSTIC LOAD MEMBER (CONT.)

(FIG. 7 CONTINUED)
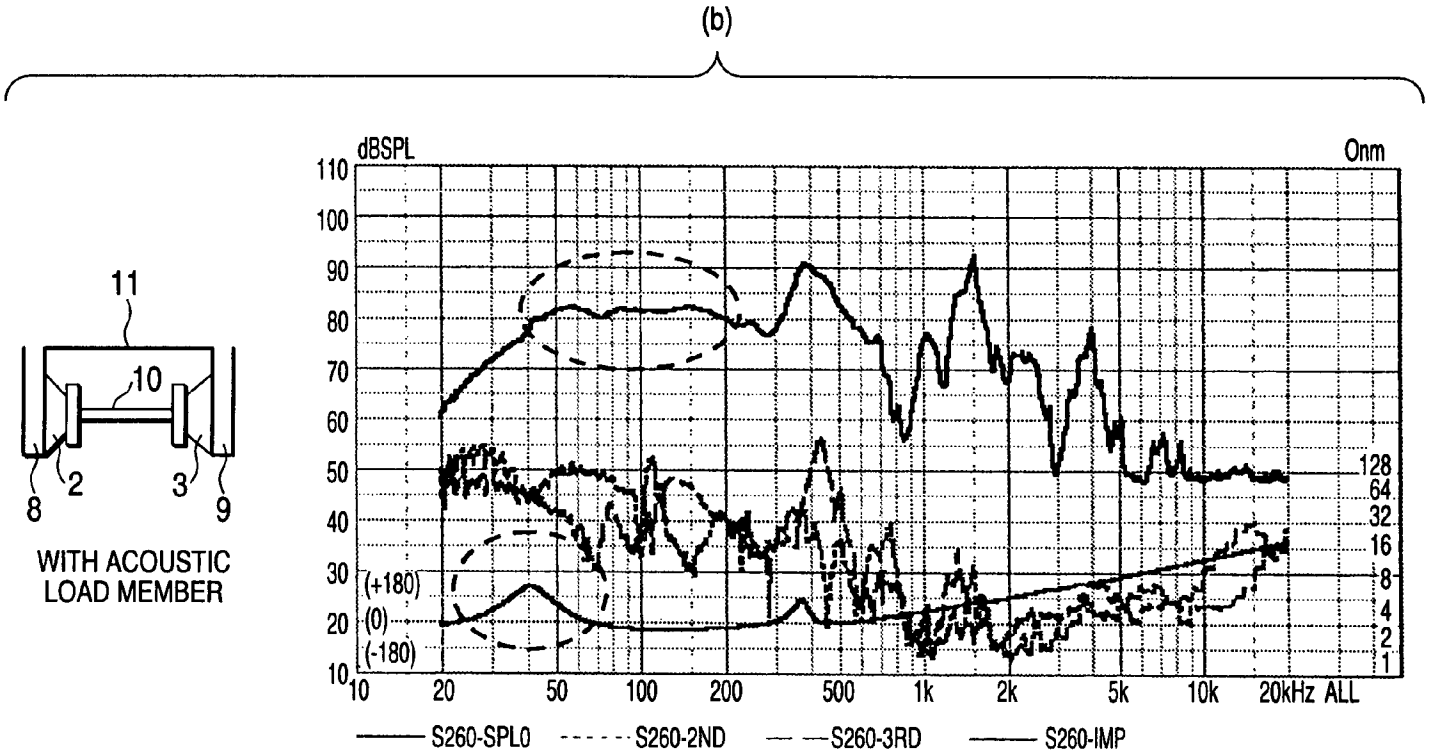

SPEAKER DEVICE

BACKGROUND OF THE INVENTION

1. Field of the Invention

The present invention relates to a speaker device capable of reproducing sound in high quality tones.

2. Description of the Related Art

In a conventional speaker device, a vibration plate is electrically driven in a speaker unit. A vibration of the vibration plate is converted to an acoustic output. In the speaker unit, the acoustic output is generated by the vibration plate that is formed into various profiles such as a cone, flat plate, dome or the like. In order to generate a driving force to drive the vibration plate, an electrodynamic type driving section is used. In the electrodynamic type driving section, a magnetic circuit, the magnetic flux source of which is a permanent magnet, is used. In the magnetic circuit, magnetic flux is concentrated in a space referred to as a magnetic gap, so that an electromagnetic driving force can be generated in a voice coil in the magnetic gap. In the speaker unit, a frame holds the magnetic circuit, and the vibration plate is supported so that the voice coil can be displaced in the driving direction. Usually, a surface of front side of the vibration plate on which the magnetic circuit is not arranged serves as an acoustic emission face. A displacement of the surface of the vibration plate generates a compressional change in the air, so that an acoustic output is emitted into the space. The displacement of the vibration plate generates an acoustic output on the back side as well, the compressional phase of which is inverse to that on the surface side. When the acoustic output on the acoustic emission face side and the acoustic output on the back side are mixed with each other, since the phases are inverse to each other, the acoustic output of the vibration plate is lowered. This influence given by the acoustic output on the back side is remarkable in the sound region of low frequency (bass).

In many cases, in order to effectively obtain an acoustic output from the acoustic emission face of the vibration plate of the speaker unit, the speaker unit is accommodated in an enclosure such as a cabinet or a speaker box so that an acoustic output from the back side can not come to the side of the acoustic emission face. Only the acoustic emission face of the vibration plate is exposed to a surface of the enclosure.

In the speaker unit, a reaction of the motion of the vibration plate to generate sound tends to be transmitted to the frame side and causes vibration in the frame and the magnetic circuit. Since energy to drive the vibration plate leaks to a support system such as the frame, an intensity of energy, which is transmitted from the vibration plate to the air to become an acoustic output, is reduced, and the energy transmitting efficiency is lowered. By the energy that leaks to the support system, there is a possibility that each portion composing the speaker unit and the enclosure vibrate at their natural vibration frequencies, while being induced by the drive of the vibration plate. The thus generated vibration continues even after the driving of the vibration plate is stopped. The thus caused sound remains and is mixed with the acoustic output to be originally reproduced. This deteriorates the transient characteristic of the reproduced sound and the reproduced sound quality is lowered because the feeling of speed of the reproduced sound is hurt. In order to enhance the feeling of speed of the reproduced sound, it is advantageous to use a speaker of a small diameter, the vibration plate diameter of which is small, because the weight of the vibration system is decreased and the transient characteristic is enhanced. However, only when the diameter is decreased, mass of the air loaded on the surface of the vibration plate is decreased. This is disadvantageous in that the minimum resonance frequency is increased. In order to enhance the reproduced sound quality of the speaker device, it is necessary to suppress the occurrence of unnecessary vibration caused in each portion. In general, when mass of the frame of the speaker unit and the magnetic circuit is increased and mass of the enclosure is also increased, unnecessary vibration of each portion is seldom caused.

JP-UM-A-6-66194 discloses the following prior art. In order to reduce the occurrence of vibration and resonance while decreasing the weight of the speaker system, a plurality of speaker units are arranged on the horizontal face so that the axes of the speaker units can be dynamically balanced with respect to the direction of the motion of the vibration system. Further, the plurality of speaker units are arranged so that the axes have the same angle of elevation with respect to the horizontal face on the vertical face. The support systems of the speaker units are bound by a binding member, the rigidity in the axial direction of which is high. In this prior art, in the case where the number of speaker units is two in which a magnetic circuit is provided on the back of a vibration plate, although the magnetic circuits are opposed to each other on the horizontal face, since the speaker units are tilted by a predetermined angle of elevation with respect to the horizontal face, the axes of the two speaker units are not located on the same straight line but the axes of the two speaker units are tilted to each other and sound are reproduced. Therefore, the binding member is also joined to an inner wall face of the cabinet on the extension of the axis of each speaker unit.

Japanese Utility Model Registration No. 3008172 discloses the following prior art of a wall mounting type speaker. In a cabinet, a fixture attached to the back side of a speaker unit is extended and protruded outside the cabinet and attached to a wall face on which the cabinet is fixed. Since the speaker unit is attached to the wall face via the fixture, it is expected that the occurrence of vibration can be suppressed. JP-A-2001-78285 discloses the following prior art. A speaker unit is attached to an egg-shaped enclosure, and a rod-shaped member attached to the center of gravity of a magnetic circuit on the back of the speaker unit is extended to the back side. This rod-shaped member is mechanically supported and statically balanced by using a weight so as to suppress the occurrence of unnecessary vibration.

In the prior art disclosed in the Japanese Utility Model Registration No. 3008172 and JP-A-2001-78285, the speaker unit is also supported by the outside of the enclosure. Accordingly, a place where the speaker device can be installed is restricted. Further, it takes time and labor to install the speaker device. Even in the prior art disclosed in JP-UM-A-6-66194, since the speaker units are connected to each other by the binding member and also connected to the cabinet, it takes time and labor to attach the binding member.

In the speaker device, it is popular that the speaker unit is screwed to a front face of the speaker box or the cabinet. In this structure, vibration generated in the speaker unit tends to be transmitted to the enclosure. Therefore, sound, the phase of which is shifted, is generated from the surface of the enclosure. This deteriorates the reproduced sound. When the speaker unit is more strongly supported by mechanical means like the prior art described above, it can be expected that vibration generated by the speaker unit is suppressed.

However, it takes more time and labor to more strongly support the speaker unit. Further, in order to mechanically support the speaker unit, the number of parts is increased. This raises the manufacturing cost.

SUMMARY OF THE INVENTION

An object of the present invention is to provide a speaker device in which the occurrence of vibration can be suppressed with a small number of parts and the quality of reproduced sound can be enhanced.

The present invention provides a speaker device having:

a pair of speaker units each of which including a vibration plate and a driving section for electrically driving the vibration plate;

a binding member for mechanically connecting the driving sections in a manner that the driving sections are opposed to each other with axes of the driving of the vibration plates being located on the same straight line; and a pair of acoustic load members each of which arranged on one side of each vibration plate that is opposite side to the other of the speaker units, wherein each acoustic load member gives an acoustic load to each vibration plate so as to introduce an acoustic output from the vibration plate.

According to the present invention, since the driving sections are mechanically connected to each other by the binding member in a manner that the driving sections for electrically driving vibration plates are opposed to each other with the axes of the driving sections being located on the same straight line, vibrations generated in the support system of the speaker unit can be canceled to each other. On one side of each speaker unit on which the driving section to drive the vibration plate is not provided, the acoustic load member is arranged, by which an acoustic output can be introduced when the acoustic load is given to the vibration plate. Since the acoustic load is given to the vibration plate by the acoustic load member, even when the transient characteristic is enhanced by using a vibration plate of a small diameter, it is possible to reproduce sound of low frequency while reducing the resonance frequency of the vibration system. Since sound of low frequency can be reproduced and the transient characteristic can be improved by suppressing vibration, it is possible to enhance the quality of reproduced sound. It is only required for the binding member to connect the driving sections of the speaker units. Therefore, the number of parts necessary for supporting the binding member can be decreased, which reduces the manufacturing cost.

In the present invention, the pair of speaker units and acoustic load members may be arranged in an adjoining space which adjoins a vehicle compartment of a vehicle with the driving sections of the speaker units being connected to each other by the binding member, and each acoustic load member may have an opening from which an acoustic output from each speaker unit is introduced to the vehicle compartment.

According to the present invention, the speaker device can be arranged in a manner that a space adjoining the vehicle compartment such as a trunk room is made to function as an enclosure, a pair of speaker units are connected to each other by connecting the driving members with the binding member, and an acoustic load can be given to each speaker unit. In the above arrangement, since the opening is provided from which an acoustic output is introduced out from the acoustic load member into the vehicle compartment, it is possible to take out reproduced sound, the transient characteristic of which is high, into the vehicle compartment. It is unnecessary to support the biding member by the vehicle body. Therefore, it is possible to install the speaker device in the vehicle without requiring lots of time and labor. Further, the number of parts can be decreased, thereby reducing the manufacturing cost.

In the present invention, each acoustic load member may cover a space on the one side of the vibration plate of each speaker unit so as to introduce an acoustic output from each vibration plate in a predetermined direction perpendicular to the axis of the driving of the vibration plate.

According to the present invention, the pair of speaker units connected to each other by the binding member and the acoustic load member are accommodated in the enclosure or a space which functions as the enclosure, and only the reproduced sound of high quality tones can be taken out from the opening to an objective space in which acoustic reproduction is conducted.

In the present invention, the binding member maybe screwed to the driving section of each speaker unit.

According to the present invention, the driving sections of the pair of speaker units are connected to each other by the binding member that is screwed to the respective driving sections. Therefore, the pair of speaker units can be connected only by the binding member, thereby decreasing the number of parts and labor.

The present invention provides a speaker device having:

a pair of speaker units each of which including a vibration plate and a driving section for electrically driving the vibration plate;

a binding member for mechanically connecting the driving sections in a manner that the driving sections are opposed to each other with axes of the driving of the vibration plates being located on the same straight line; and a pair of buffer members each of which disposed in a portion on one side of each vibration plate that is opposite side to the other of the speaker units, the portion is attachable to an enclosure for each speaker unit, wherein the binding member is respectively screwed to the driving section of each speaker unit.

According to the present invention, the driving sections are mechanically connected to each other by the binding member in a manner that the driving sections for electrically driving vibration plates are opposed to each other with the axes of the respective driving sections being located on the same straight line. Therefore, vibrations generated in the support system of the speaker unit can be canceled to each other. Since each speaker unit is attached to the enclosure via the buffer member, it is possible to suppress vibration from being transmitted to the enclosure. Since vibration of the speaker unit and the enclosure is suppressed, the transient characteristic can be improved and the quality of reproduced sound can be enhanced. The driving sections of the speaker units are connected to each other by the binding member by means of screwing. Therefore, the number of parts can be decreased, and the manufacturing cost can be reduced.

In the present invention, the binding member may have screw sections in both end portions thereof, the driving section of each speaker unit may have a screw section, and the both end portions of the binding member and the drive sections may be simultaneously fastened when the binding member is rotated in a predetermined direction.

According to the present invention, when the binding member is rotated in a predetermined direction, it can be simultaneously screwed to the driving sections of the pair of speaker units. Therefore, it is possible to omit labor and time necessary for connecting the speaker units.

In the present invention, a front face profile of the vibration plate of the speaker unit may be oblong.

According to the present invention, the profile of the front face of the vibration plate of the speaker unit is oblong, that is, the profile of the front face of the vibration plate of the speaker unit is elliptic or rectangular. Therefore, when this oblong front face of the vibration plate of the speaker unit is arranged in a trunk room of a vehicle, the speaker device can be made thin and a space in the trunk room can be saved.

DETAILED DESCRIPTION OF THE PREFERRED EMBODIMENTS

Figure 1:
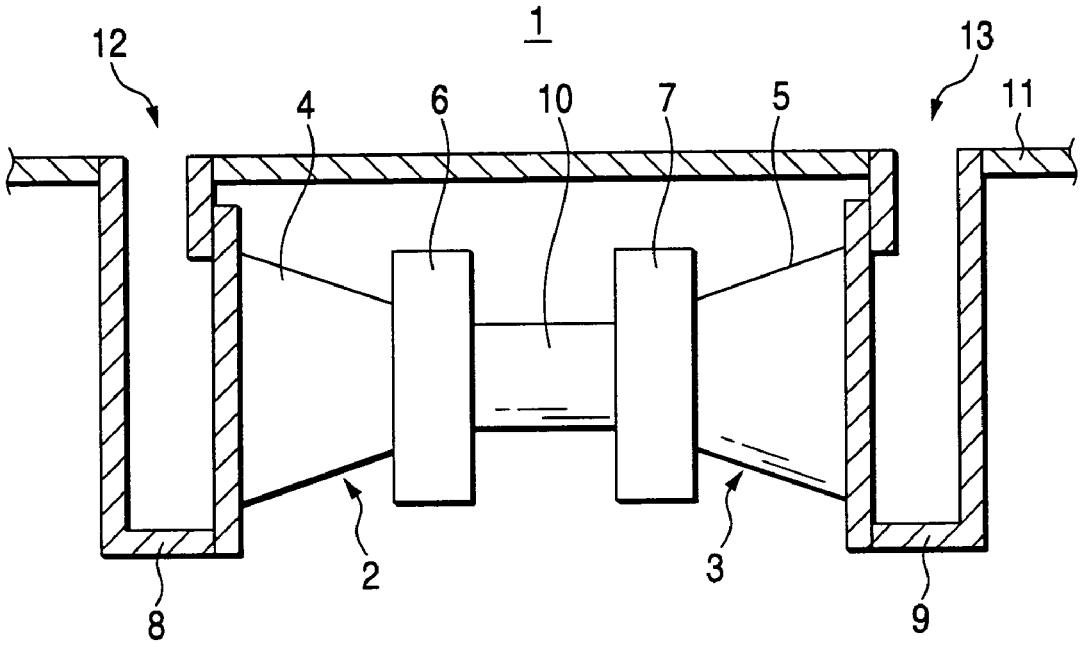
FIG. 1 is a simplified sectional view showing an outline of a speaker device 1 which is an embodiment of the present invention.

FIG. 1 is a schematic view showing an outline of a speaker device 1 which is an embodiment of the present invention. In this embodiment, a pair of electrodynamic type speaker units 2 and 3, which are of the same type, are used. Frames 4, 5 support vibration plates and magnetic circuits 6, 7 in speaker units 2, 3. The vibration plate is made of paper, synthetic resin, metal or combined material, in which they are combined with each other, and formed into a conical shape. The peripheral portion of the vibration plate is supported by the frame 4, 5 via a part referred to as an edge, so that the vibration plate is reciprocatingly displaced in an axis direction thereof. A bobbin of the voice coil of the speaker is joined to the center of the conical vibration plate. The voice coil is wound in a portion located in the magnetic gap formed in the magnetic circuit 6, 7 by the bobbin. An intermediate portion of the bobbin is supported by the frame 4, 5 via a part referred to as a damper. The magnetic flux generated by a permanent magnet is concentrated in the magnetic gap at high density. Therefore, when an electric current is made to flow in the voice coil, a driving force to drive the vibration plate is generated by an electromagnetic interaction. When the vibration plate is displaced, a compressional change is caused in the air. Therefore, a sound wave is generated by the mechanical displacement of the vibration plate. In this way, electric power to drive the voice coil can be converted into an acoustic output. On the front side on which the acoustic output is emitted from each frame 4, 5, an acoustic load member 8, 9, which gives a load to the vibration plate, is arranged. A binding member 10 is mechanically connected with the magnetic circuits 6, 7 in such a manner that the magnetic circuits 6, 7 of the pair of speaker units 2, 3 are opposed to each other and axes 2*a*, 3*a* of driving the vibration plates are located on the same straight line.

In an enclosure 11 of the speaker device 1, the pair of speaker units 2, 3 are accommodated in such a manner that the magnetic circuits 6, 7 provided on the back faces of the speaker units 2, 3 are connected to each other by the binding member 10 being opposed to each other, and the acoustic load members 8, 9 are attached to the front faces of the pair of speaker units 2, 3. In order to take out an acoustic output to the outside of the enclosure 11, an opening 12, 13 is formed in one portion of each acoustic load member 8, 9. Each acoustic load member 8, 9 defines a space, which is provided on the front face side of each frame 4, 5 of each speaker unit 2, 3, having a depth that prevents the vibration plate from colliding with the acoustic load member 8, 9 even when the vibration plate protrudes forward. The space is defined by the acoustic load member 8, 9 in such a manner that the acoustic load member 8, 9 is not communicated to the outside except for the opening portion 12, 13 formed on one side. When the pair of speaker units 2, 3 are driven in parallel at the same polarity, since the back faces are connected to each other, vibrations generated can be canceled to each other.

Figure 2:
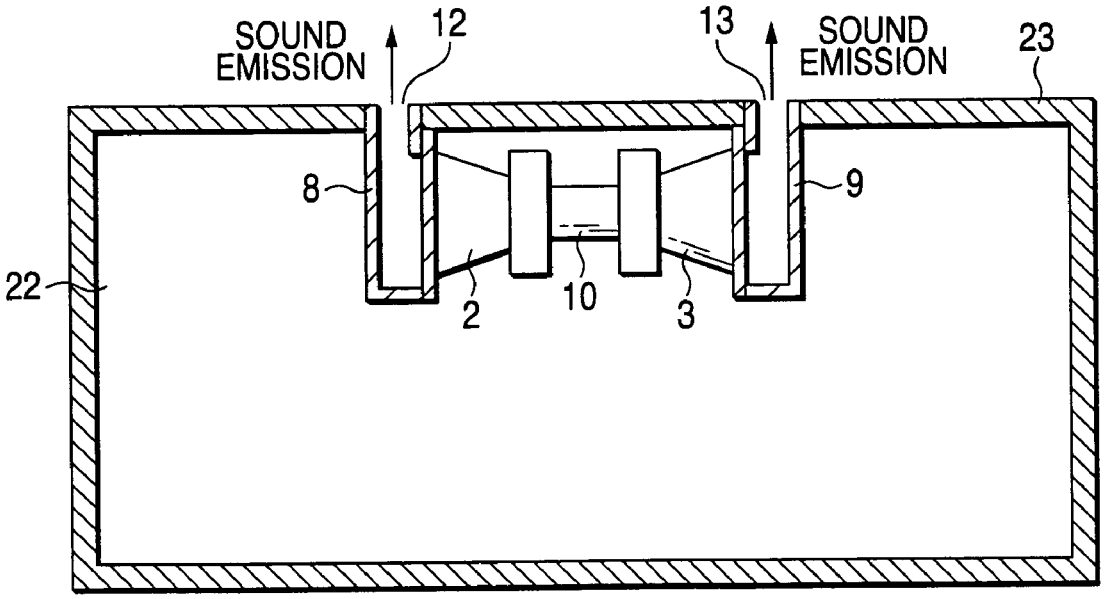
FIG. 2 is a partial sectional front view showing a state in which the speaker device 1 shown in FIG. 1 is mounted on a vehicle body 20 of a vehicle.
Figure 3:
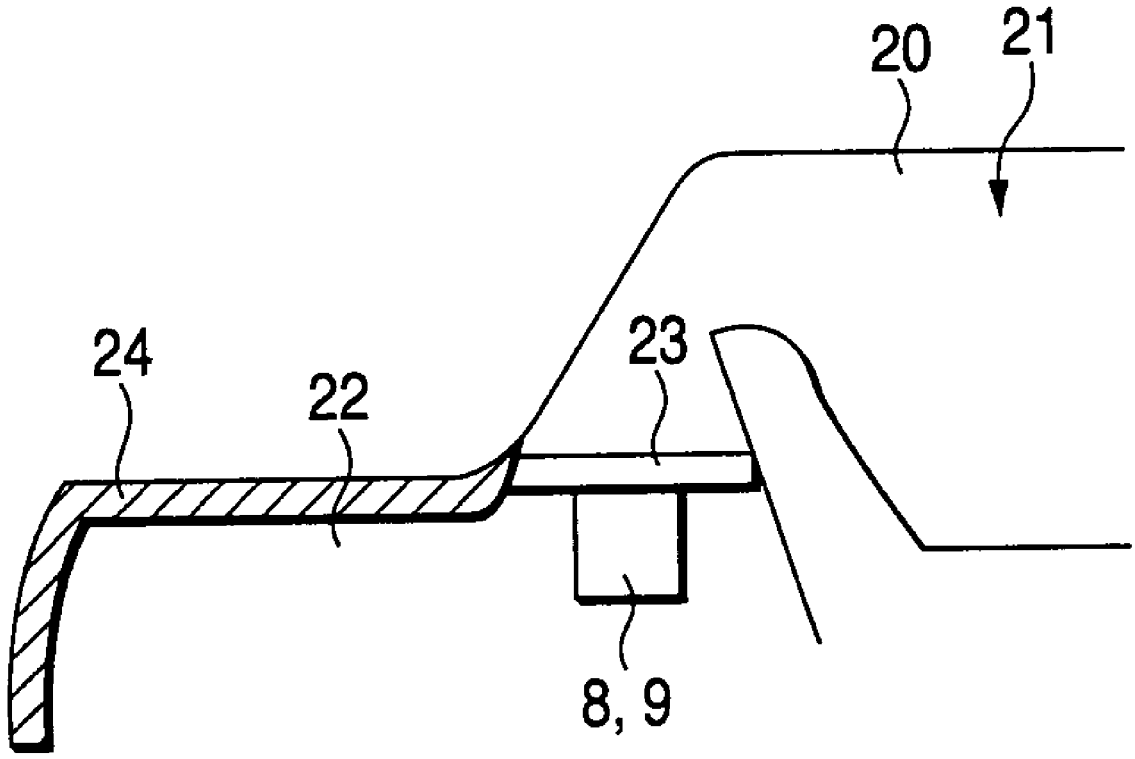
FIG. 3 is a partial sectional side view showing a state in which the speaker device 1 shown in FIG. 1 is mounted on the vehicle body 20.

FIGS. 2 and 3 are views showing a state in which the speaker device 1 shown in FIG. 1 is attached to a vehicle body 20 of a passenger car. In order for a passenger in the vehicle compartment 21 to conduct audio-reproduction, for example, while the trunk room 22, which adjoins the vehicle compartment 21, is being utilized as the enclosure 11 shown in FIG. 1, the speaker device 1 is installed. The openings 12, 13 are arranged in the upper pack 23 which is located in an upper portion of the trunk room 22. The door 24 of the trunk room 22 is opened and the installing the speaker device 1 is conducted from the rear of the vehicle body 20. In this case, the pair of speakers 2, 3, the acoustic load members 8, 9 and the binding member 10 are previously combined and integrated into one body, and the thus integrated body is attached to the vehicle body. Therefore, the installing work of the speaker device 1 can be simply conducted without requiring lots of labor and time.

Figure 4A:
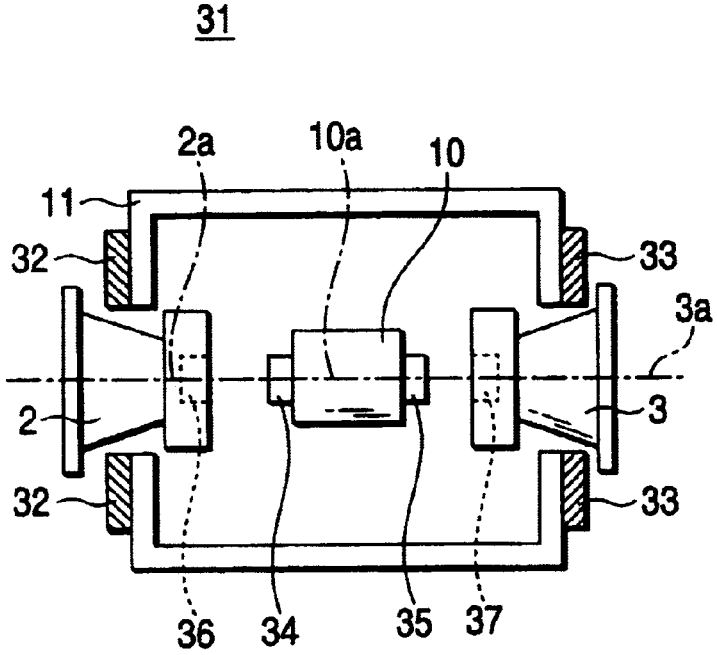
FIGS. 4A to 4D are simplified sectional views showing an outline of a speaker device 31 which is another embodiment of the present invention.
Figure 4B:
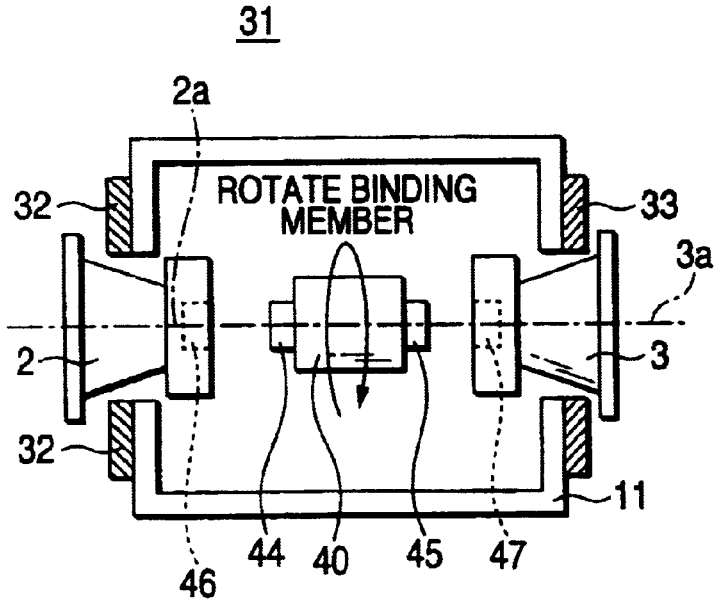

FIGS. 4A and 4B are views showing an outline of a speaker device 31 which is another embodiment of the present invention. Like reference characters are used to indicate like parts in FIGS. 1 and 4, and the same explanations are omitted here. FIG. 4A is a view showing a common structure, and FIG. 4B is a view showing a structure by which the working property can be improved. This embodiment is characterized in that the speaker units 2, 3 are connected to each other by the binding member 10. Of course, the structure of this embodiment can be applied to the embodiment shown in FIG. 1.

In FIGS. 4A and 4B, when the frames 4, 5 of the respective speaker units 2, 3 are attached to the surface of the enclosure 11, buffer members 32, 33 are respectively interposed between the speaker units 2, 3 and the surface of the enclosure 11. The buffer members 32, 33 are made of material, the damping property of which is high, such as felt, vibration-resistant rubber or gel. When the buffer members 32, 33 are interposed, vibration is seldom transmitted from the speaker units 2, 3 to the enclosure 11 such as a cabinet. Therefore, vibration of the enclosure 11 can be suppressed. Further, driving forces generated by the pair of speaker units 2, 3 act in the opposite directions to each other. Therefore, vibrations are canceled to each other and reduced.

The positional relationship of the speaker units 2, 3, the enclosure 11 and the buffer members 32, 33 are not limited to as described in FIGS. 4A and 4B. The buffer members 32, 33 may be disposed at positions where the buffer members can prevent vibration of the speaker units 2, 3 from transmitting to the enclosure 11, for example, positions shown in FIGS. 4C and 4D.

The binding member 10 is made of nonmagnetic metal of high specific gravity such as stainless steel or brass. In general, magnetic flux leaks from the magnetic circuit 6, 7. Especially when an annular permanent magnet, which is referred to as an external magnetic type magnet, is used for the magnetic circuit 6, 7, a strong magnetic force acts on the back face of the magnetic circuit 6, 7. In the case where the binding member 10 is made of ferromagnetic material such as iron, a strong repelling force is generated. Therefore, it becomes difficult to conduct binding. Further, since the magnetic flux tends to leak via the binding member to be connected, the magnetic flux density in the magnetic gap in the magnetic circuit 6, 7 is lowered, and the sound reproducing efficiency of the speaker is deteriorated.

In the structure shown in FIG. 4A, an axis 10*a* of the binding member 10 is arranged so that it can be located on the same line as axes 2*a*, 3*a* of the speaker units 2, 3. Male screws 34, 35 are respectively formed at both end portions of the binding member 10 in the axial direction. For the male screws 34, 35, the female screws 36, 37 to be screwed to the male screws 34, 35 are respectively formed at the centers on the back faces of the magnetic circuits 6, 7. When the female screws 36, 37 are screwed to the male screws 34, 35 in the same manner, the speaker units 2, 3 can be integrated into one body. The speaker units 2, 3 and the binding member 10 can be screwed to each other as follows. For example, one of the speaker units 2, 3 is attached to the enclosure 11 beforehand, and then the binding member 10 is screwed to the magnetic circuit of one speaker unit. Then, while the magnetic circuit of the other speaker unit is being screwed to the binding member 10, the speaker unit can be attached to the enclosure 11.

In the structure shown in FIG. 4B, the speaker units 2, 3 are connected to each other by the binding member 40 similar to the binding member 10. In the binding member 40, the directions of the male screws 44, 45 formed at both end portions of the axis 40*a* are changed so that the male screws 44, 45 can be respectively fitted to the female screws 46, 47 formed in the magnetic circuits 6, 7. Due to this structure, when the binding member 40 is rotated round the axis 40*a*, the both sides can be simultaneously fastened and loosened according to the rotary direction. When this type of binding member 40 is used, the pair of speaker units 2, 3 can be simultaneously connected, and it is possible to save labor and time.

Figure 5:
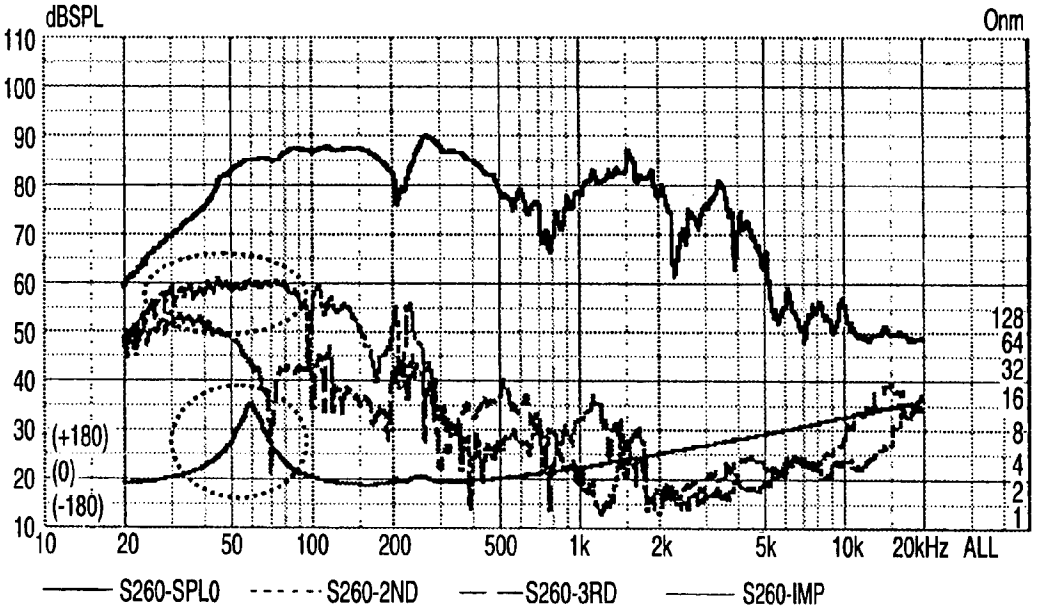
FIG. 5 is a graph showing an effect provided by the embodiment shown in FIGS. 4A and 4B.
Figure 5:
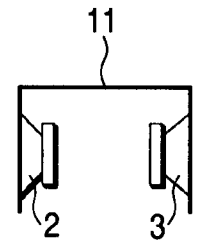

FIG. 5 is a graph showing a result of the measurement made in an anechoic chamber so as to find a result of connecting a pair of speakers 2, 3 as shown in FIGS. 4A and 4B. FIG. 5(*a*) is a graph showing the output sound pressure characteristic, the harmonic distortion characteristic and the electric impedance characteristic obtained when the speaker units 2, 3 are driven in the same way in the case where the speaker units 2, 3 are attached to the enclosure 11 under the condition that the speaker units 2, 3 are not connected to each other and the back faces of the speaker units 2, 3 are simply opposed to each other. FIG. 5(*b*) is a graph showing the output sound pressure characteristic, the harmonic distortion characteristic and the electric impedance characteristic obtained when the speaker units 2, 3 are driven in the same way in the case where the speaker units 2, 3 are attached to the enclosure 11 under the condition that the speaker units 2, 3 are connected to each other. When the electric impedance characteristic shown in FIG. 5(*a*) and that shown in FIG. 5(*b*) are compared with each other, it can be understood that sharpness Q0 of resonance of the speaker device is lowered from 0.6 to 0.45. When sharpness Q0 of resonance of the speaker device is lowered as described above, it is possible to enhance the damping property to damp vibration and further it is possible to improve the transient property, so that the quality of reproduced sound can be enhanced. When the secondary distortion shown in FIG. 5(*a*) and that shown in FIG. 5(*b*) are compared with each other in the case where the frequency is not more than 100 Hz, it can be understood that the secondary distortion is lowered by 5 dB. When the secondary distortion is lowered as described above, the quality of reproduced sound can be enhanced.

Figure 6:
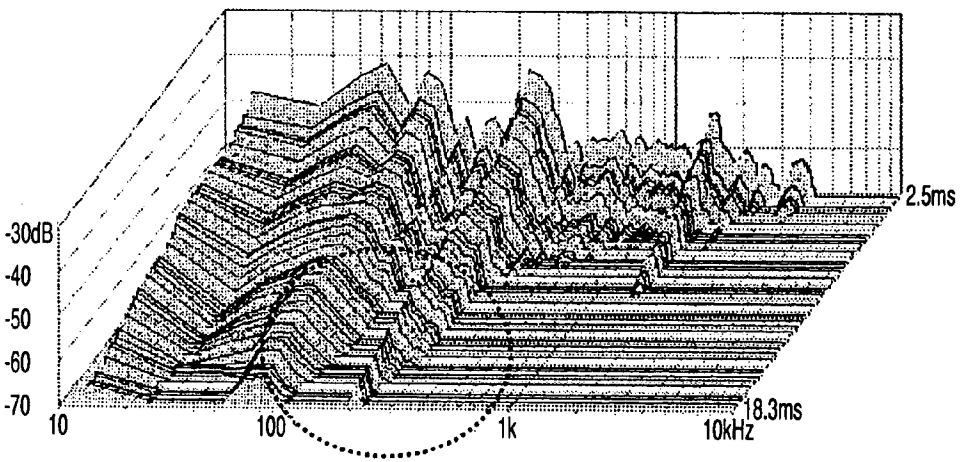
FIG. 6 is a graph showing an effect provided by the embodiment shown in FIGS. 4A and 4B.
Figure 6:
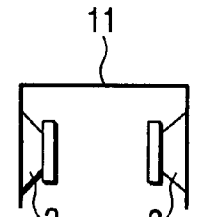

FIG. 6 is a graph in which the effect of connecting the pair of speaker units 2, 3 as shown in FIGS. 4A and 4B is compared with the effect of not connecting the pair of speaker units 2, 3. In this case, the effects are compared by the cumulative spectrum data. The cumulative spectrum data can be obtained when the impulse response is analyzed by means of fast Fourier transform (FFT). The cumulative spectrum data shows a change in the frequency characteristic of the acoustic output with respect to the impulse output when the time passes. As shown in FIG. 6(*a*), when the back faces of the speaker units are not connected to each other, for example, in order to damp the vibration of 250 Hz by 30 dB, it takes 16 msec. On the other hand, as shown in FIG. 6(*b*), when the back faces of the speaker units are connected to each other, in order to damp the vibration of 250 Hz by 30 dB, it takes only 12 msec.

Figure 7:
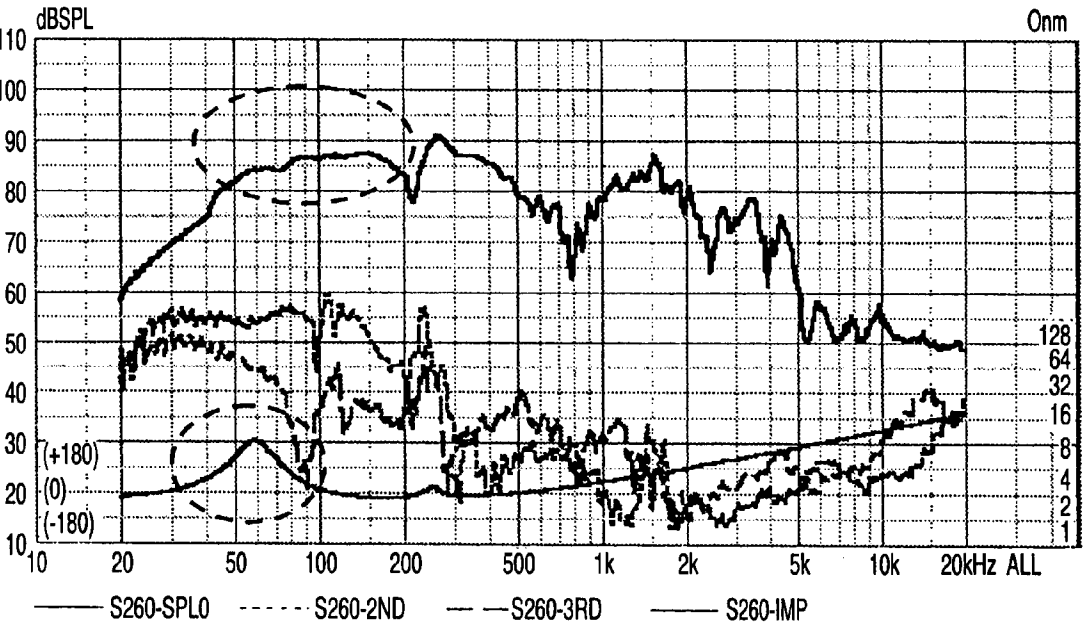
FIG. 7 is a graph showing an effect provided by the embodiment shown in FIG. 1.
Figure 7:
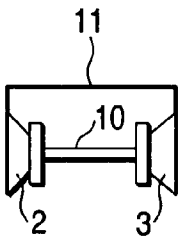

FIG. 7 is a graph showing a result of the measurement in which the acoustic load members 8, 9 are used in the embodiment shown in FIG. 1 in the case where the output sound pressure characteristic, the harmonic distortion characteristic and the electric impedance characteristic are measured in an anechoic chamber. FIG. 7(*a*) is a graph showing a characteristic in the case where the acoustic loads 8, 9 are not used and the back faces of the speaker units are connected to each other, and FIG. 7(*b*) is a graph showing a characteristic in the case where the acoustic loads 8, 9 are used and the back faces of the speaker units are connected to each other. As can be seen in the electric impedance characteristic, Q0 is further lowered from 0.45 to 0.41. It is also can be seen that the resonance frequency F0 is lowered from 60 Hz to 40 Hz. As can be seen in the output sound pressure characteristic, the flat band of sound of low frequency is extended from 80 Hz and more to 40 Hz and more.

By the speaker device 1 of the embodiment shown in FIG. 1, it is possible to reproduce sound of low frequency even when the speaker units are attached to the enclosure 11 of a small volume. In general, in the case of sound of low frequency, the directivity of the reproduced sound is not so strong that a sense of incongruity is not given even by a single sound source when multiple channels are reproduced by a stereophonic sound reproduction system. Accordingly, as shown in FIGS. 2 and 3, when one speaker device 1 is installed in the trunk room 22 so as to exclusively reproduce sound of low frequency and the speakers are installed for each channel so as to reproduce sound of intermediate and high frequencies, it is possible to reproduce sound of high quality in the multiple channels as the entire speaker system.

Figure 8A:
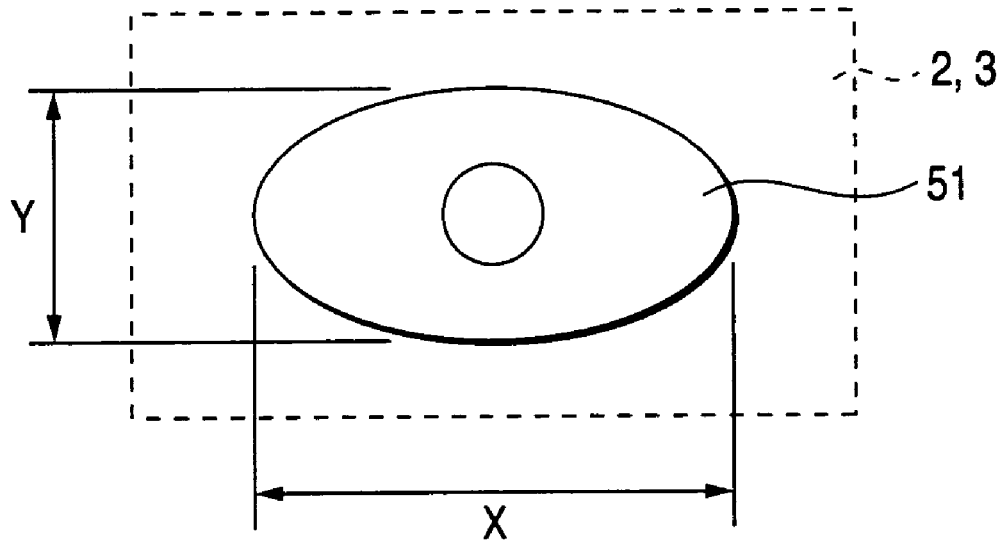
FIGS. 8A and 8B are simplified front views showing vibration plates of speaker units 2, 3 which is still another embodiment of the present invention.
Figure 8B:
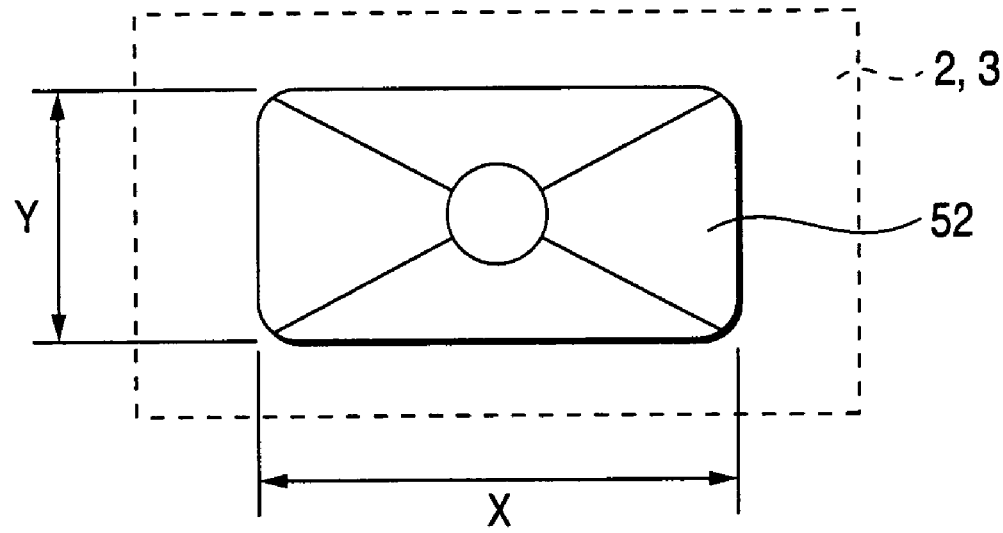

FIGS. 8A and 8B are views showing still another embodiment in which the profile of the front face of the vibration plate of the speaker unit 2, 3 of the embodiment shown in FIG. 1 or 4 is formed into not a circle but an oblong shape. FIG. 8A is a view showing an arrangement of the speaker unit 2, 3 having an elliptical vibration plate 51, and FIG. 8B is a view showing an arrangement of the speaker unit 2, 3 having a rectangular vibration plate 52. The elliptical vibration plate 51 and the rectangular vibration plate 52 are respectively formed into a conical shape or flat shape as a whole. When the profile of the front face of the speaker unit is formed elliptical or rectangular and the speaker unit is used in a posture so that the diameter X in the lateral direction and the diameter Y in the vertical direction can satisfy the inequality X>Y, the speaker device 1, 31 shown in FIG. 1 or 4 can be made thin. When the speaker device 1, 31 is arranged in the trunk room 22 of a vehicle, there is a possibility that the space in the trunk room 22 is reduced and inconvenience is caused. However, when the speaker device 1, 31 is made thin, the space in the trunk room 22 is not reduced unnecessarily so that inconvenience can be eliminated.

Figure 4C:
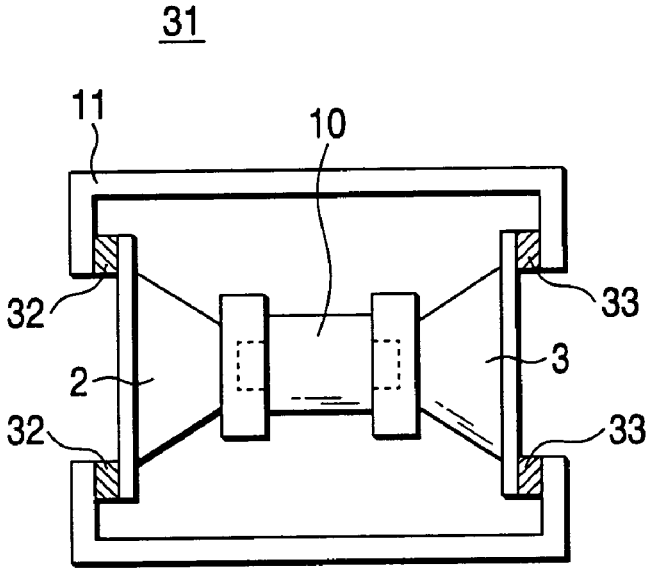
Figure 4D:
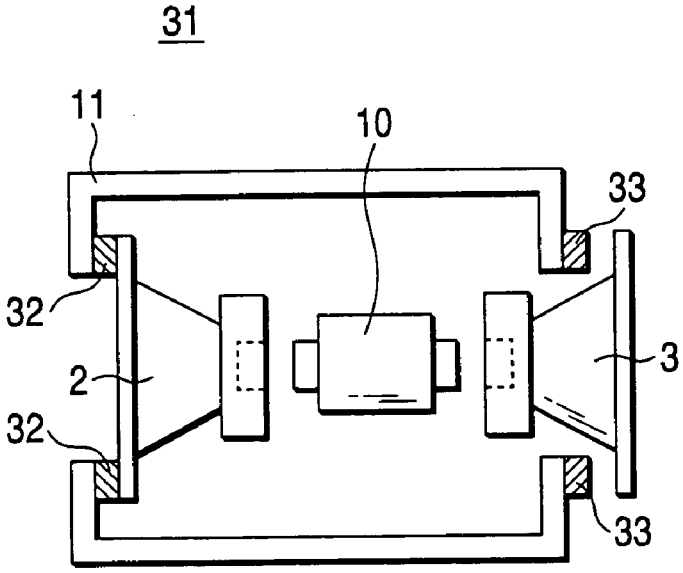

In FIG. 1, an embodiment in which the acoustic load is disposed on the speaker unit is described. In FIGS. 4A to 4C, embodiments in which the damper is disposed between the speaker unit and the enclosure are described. The present invention, however, is not limited to as herein described. The buffer member may be disposed between the acoustic load and the enclosure and/or may be disposed between the speaker unit and the acoustic load in the embodiment shown in FIG. 1. An acoustic load may be disposed on the speaker unit in the embodiments shown in FIGS. 4A to 4C.

As described above, according to the present invention, the driving sections are mechanically connected to each other by the binding member so that the driving sections for electrically driving vibration plates can be opposed to each other and arranged while the axes of the respective driving sections are being located on the same straight line. Therefore, vibrations generated in the support system of the speaker unit can be canceled to each other. Since the vibration plate is given an acoustic load by the acoustic load, it is possible to reduce a resonance frequency of the vibration system. Since sound of low frequency can be reproduced and the transient characteristic can be improved by suppressing the occurrence of vibration, the quality of reproduced sound can be enhanced. Since it is sufficient that the binding member connects the drive sections of the two speaker units, the number of parts required for supporting the binding member can be decreased, and the manufacturing cost can be reduced.

According to the present invention, the speaker device can be arranged as follows. A pair of speaker units are arranged, for example, in a trunk room of a vehicle under the condition that the binding members are connected to each other so that an acoustic load can be given to each speaker unit. In the above arrangement, it is possible to take out reproduced sound, the transient characteristic of which is high, into the vehicle compartment. It is unnecessary to support the biding member by the vehicle body. Therefore, it is possible to install the speaker device in the vehicle without requiring time and labor. Further, the number of parts can be decreased, which reduces the manufacturing cost.

According to the present invention, with respect to an objective space in which acoustic reproduction is conducted, the pair of speaker units connected to each other by the binding member and the acoustic load are accommodated in the enclosure or a space which functions as an enclosure, and only the reproduced sound of high tone quality can be taken out from the opening.

According to the present invention, the driving sections of the pair of speaker units are connected to each other by the binding member connected with the respective driving sections. Therefore, the pair of speaker units can be connected only by the binding member, which decreases the number of parts and labor.

According to the present invention, the driving sections for electrically driving vibration plates are mechanically connected to each other by the binding member. Therefore, vibrations generated in the support system of the speaker unit can be canceled to each other. Since each speaker unit is attached to the enclosure via the buffer member, it is possible to suppress vibration from being transmitted to the enclosure. Therefore, the transient characteristic can be improved and the quality of the reproduced sound can be enhanced. The driving sections of the speaker units are connected to each other by the binding member by means of screwing. Therefore, the number of parts can be decreased, and the manufacturing cost can be reduced.

According to the present invention, the binding member can be simultaneously screwed to the driving sections of the pair of speaker units. Therefore, it is possible to save labor and time necessary for connecting the speaker units.

According to the present invention, the profile of the front face of the vibration plate of the speaker unit is oblong, that is, the profile of the front face of the vibration plate of the speaker unit is elliptic or rectangular. Therefore, when the speaker unit is arranged so that this oblong front face of the vibration plate of the speaker unit can be set, the speaker device can be made thin and a space in the trunk room can be saved. Accordingly, it is possible to avoid the occurrence of inconvenience when the trunk room is used.

What is claimed is:

1. A speaker device, comprising:

a pair of speaker units each of which including a vibration plate and a driving section for electrically driving the vibration plate;

a non-magnetic binding member for mechanically connecting the driving sections in a manner that the driving sections are opposed to each other with axes of the driving of the vibration plates being located on the same straight line; and a pair of acoustic load members each of which is arranged on one side of each vibration plate that is opposite a side to the other of the speaker units, wherein each acoustic load member gives an acoustic load to each vibration plate so as to introduce an acoustic output from the vibration plate, and the binding member is screwed to the driving section of each speaker unit.

2. A speaker device according to claim 1, wherein the pair of speaker units and acoustic load members are arranged in an adjoining space which adjoins a passenger compartment of a vehicle with the driving sections of the speaker units being connected to each other by the binding member, and each acoustic load member has an opening from which an acoustic output from each speaker unit is introduced to the vehicle compartment.

3. A speaker device according to claim 1, wherein each acoustic load member covers a space on the one side of the vibration plate of each speaker unit and introduces an acoustic output from each vibration plate in a predetermined direction perpendicular to the axis of the driving of the vibration plate.

4. A speaker device according to claim 1, wherein a front face profile of the vibration plate of the speaker unit is oblong.

5. A speaker device according to claim 1, wherein the binding member has an axis located on the same straight line as the axes of the driving of the vibration plates.

6. A speaker device according to claim 2, wherein the binding member has an axis located on the same straight line as the axes of the driving of the vibration plates.

7. A speaker device comprising:

a pair of speaker units each of which including a vibration plate, a driving section for electrically driving the vibration plate and an attaching portion to be attached to an enclosure;

a non-magnetic rotatable binding member for mechanically connecting the driving sections in a manner that the driving sections are opposed to each other with axes of the driving of the vibration plates being located on the same straight line; and a buffer member disposed between the attaching portion and the enclosure, wherein the binding member is rotated and screwed to the driving section of each speaker unit.

8. A speaker device according to claim 7, wherein the binding member has screw sections in both end portions thereof, the driving section of each speaker unit has a screw section, and the both end portions of the binding member and the drive sections can be simultaneously fastened when the binding member is rotated in a predetermined direction.

9. A speaker device according to claim 7 wherein a front face profile of the vibration plate of the speaker unit is oblong.

10. A speaker device, comprising:

a pair of speaker units each of which including a vibration plate and a driving section for electrically driving the vibration plate;

a non-magnetic rotatable binding member for mechanically connecting the driving sections in a manner that the driving sections are opposed to each other with axes of the driving of the vibration plates being located on the same straight line; and a pair of acoustic load members each of which is arranged on one side of each vibration plate that is opposite a side to the other of the speaker units; and a buffer member disposed between the speaker unit and the acoustic load member wherein the binding member is screwed to the driving section of each speaker unit.

11. A speaker device according to claim 10 wherein a front face profile of the vibration plate of the speaker unit is oblong.

12. A speaker device according to claim 10, wherein the binding member has an axis located on the same straight line as the axes of the driving of the vibration plates.

* * * * *